US011408408B2

(12) United States Patent
Wu

(10) Patent No.: US 11,408,408 B2
(45) Date of Patent: Aug. 9, 2022

(54) PORTABLE AIR PUMP INCLUDING A PISTON MOVABLE RELATIVE TO A CYLINDER PROVIDED WITH A FIRST THROUGH-HOLE, A PIVOTING SEAT PROVIDED WITH A SECOND THROUGH-HOLE, A CONNECTION MEMBER PROVIDED WITH A THIRD THROUGH-HOLE, AND A HEAD SEAT PROVIDED WITH A FOURTH THROUGH-HOLE, WHEREIN AN AXIAL MEMBER IS MOUNTED THROUGH THE FIRST THROUGH FOURTH THROUGH-HOLES

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 241 days.

(21) Appl. No.: 16/916,342

(22) Filed: Jun. 30, 2020

(65) Prior Publication Data

US 2021/0148350 A1 May 20, 2021

(30) Foreign Application Priority Data

Nov. 19, 2019 (TW) ..... 108215286

(51) Int. Cl.
*F04B 33/00* (2006.01)
*F04B 39/00* (2006.01)

(52) U.S. Cl.
CPC ..... *F04B 33/005* (2013.01); *F04B 39/0016* (2013.01)

(58) Field of Classification Search
CPC ..... F04B 33/005; F04B 39/0016
USPC ..... 417/511
See application file for complete search history.

(56) References Cited

U.S. PATENT DOCUMENTS 1,356,160 A * 10/1920 Lawley ..... F04B 33/005 92/58.1
1,737,536 A * 11/1929 Hasting ..... F04B 39/1006 417/536
D309,174 S * 7/1990 Furusawa ..... D23/231
D323,876 S * 2/1992 Furusawa ..... D23/231
5,347,913 A * 9/1994 Stepner ..... B62J 11/02 280/288.4
5,551,848 A * 9/1996 Chuang ..... F04B 33/005 92/58.1

(Continued)

*Primary Examiner* — Kenneth J Hansen
*Assistant Examiner* — Benjamin Doyle
(74) *Attorney, Agent, or Firm* — Alan D. Kamrath; Karin L. Williams; Mayer & Williams PC

(57) ABSTRACT

A portable air pump includes an inflation assembly, a head seat pivotally connected to the inflation assembly, a pressure gauge disposed in the head seat, a connection assembly pivotally connected to the inflation assembly, and an axial member. The inflation assembly includes a cylinder and a piston rod moveable relative to the cylinder to compress the air inside the cylinder. One end of the head seat is provided with the containing groove, and another end of the head seat is provided with a pedal portion. The connection assembly is adapted to connect with an air-inflatable object. The axial member is mounted through the inflation assembly and the head seat and is connected to the connection assembly. The axial member is provided with an airflow channel communicating with the cylinder, the containing groove, and the connection assembly.

11 Claims, 5 Drawing Sheets

(56) References Cited

U.S. PATENT DOCUMENTS 5,702,239 A * 12/1997 Yang ..... F04B 39/1073 417/512
5,807,078 A * 9/1998 Chen ..... F04B 25/02 417/262
6,422,832 B1 * 7/2002 Wang ..... F04B 33/00 417/536
6,736,619 B2 * 5/2004 Wu ..... F04B 33/005 417/313
7,681,489 B2 * 3/2010 Wu ..... F04B 33/005 92/58.1
7,931,451 B2 * 4/2011 Wu ..... F16L 27/04 417/234
2003/0026706 A1 * 2/2003 Wu ..... F04B 33/005 417/63
2003/0039553 A1 * 2/2003 Wang ..... F04B 33/005 417/63
2004/0086404 A1 * 5/2004 Wu ..... F04B 33/005 417/440
2008/0056922 A1 * 3/2008 Huang ..... F04B 33/005 417/559
2013/0028756 A1 * 1/2013 Wang ..... F04B 33/005 417/234
2013/0071264 A1 * 3/2013 Wang ..... F04B 33/005 417/234
2014/0090553 A1 * 4/2014 Wang ..... F04B 9/14 92/58.1
2014/0271263 A1 * 9/2014 Wang ..... F04B 33/005 417/313
2014/0271291 A1 * 9/2014 Wang ..... F04B 33/005 417/447
2015/0110644 A1 * 4/2015 Wu ..... F04B 33/005 417/63
2016/0010637 A1 * 1/2016 Chuang ..... F04B 33/00 417/63
2016/0108907 A1 * 4/2016 Wang ..... F04B 33/005 417/63
2016/0281702 A1 * 9/2016 Poertner ..... F04B 33/005
2017/0261007 A1 * 9/2017 Wang ..... F04B 33/00

* cited by examiner

PORTABLE AIR PUMP INCLUDING A PISTON MOVABLE RELATIVE TO A CYLINDER PROVIDED WITH A FIRST THROUGH-HOLE, A PIVOTING SEAT PROVIDED WITH A SECOND THROUGH-HOLE, A CONNECTION MEMBER PROVIDED WITH A THIRD THROUGH-HOLE, AND A HEAD SEAT PROVIDED WITH A FOURTH THROUGH-HOLE, WHEREIN AN AXIAL MEMBER IS MOUNTED THROUGH THE FIRST THROUGH FOURTH THROUGH-HOLES

BACKGROUND OF THE INVENTION

The present invention relates to a portable air pump and, more particularly, to a portable air pump having a pivotable pressure gage and easy to be assembled.

Generally, portable air pumps have a compact shape for convenience of carrying, but they are difficult to assemble due to their multiple and small-sized components. In addition, in order to achieve a compact appearance, portable air pumps will inevitably lose convenience during the pumping operation. For example, portable air pumps usually do not have a pressure gauge that can read the pressure value. The valve connector of the portable air pump is easily obstructed by external objects, such as rim spokes, making it difficult to connect the tire and to read the pressure value after connecting the tire. The operator can only hold the pump body with one hand and hold the handle with the other hand causing laborious pumping due to the compact appearance.

Thus, a need exists for a novel portable air pump that mitigates and/or obviates the above disadvantages.

BRIEF SUMMARY OF THE INVENTION

An objective of the present invention is to provide a portable air pump having a pivotable pressure gage that is also easy to be assembled.

A portable air pump according to the present invention comprises an inflation assembly, a head seat, a pressure gauge, a connection assembly, and an axial member. The inflation assembly includes a cylinder and a piston rod moveable relative to the cylinder to compress the air inside the cylinder. The head seat is pivotally connected to the inflation assembly. One end of the head seat is provided with a containing groove, and another end of the head seat is provided with a pedal portion. The pressure gauge is disposed in the containing groove. The connection assembly is pivotally connected to the inflation assembly and adapted to connect with an air-inflatable object. The axial member is mounted through the inflation assembly and the head seat and is connected to the connection assembly. The axial member is provided with an airflow channel communicating with the cylinder, the containing groove, and the connection assembly.

In an example, the head seat is provided with a guiding hole communicating with the containing groove. The axial member is provided with a first passage communicating with the cylinder and a second passage communicating with the containing groove. The first and second passages are communicated with the airflow channel.

In an example, a check valve assembly is disposed in the airflow channel to cause the first passage to unidirectionally communicate with the second passage.

In an example, the check valve assembly includes a check ball and a limit member abutting against the check ball.

In an example, the connection assembly includes an airflow tube, a joint member, and a valve connector. Two opposite ends of the airflow tube are connected to the joint member and the valve connector. The joint member is provided with a first threaded portion. The valve connector is adapted to connect with the air-inflatable object. The axial member defines a distal end and a proximal end opposite to the distal end. The distal end is provided with a second threaded portion threadedly connected with the first threaded portion.

In an example, the distal end is abutted against a seal ring disposed between the joint member and the distal end.

In an example, the cylinder is provided with a first through-hole. The inflation assembly includes a pivoting seat connected to the cylinder and a connection member disposed in the cylinder. The pivoting seat is provided with a second through-hole. The connection member is provided with a third through-hole. The head seat is provided with a pivoting portion disposed between the containing groove and the pedal portion. The pivoting portion is provided with a fourth through-hole. The axial member is mounted through the first, second, third, and fourth through-holes.

In an example, the cylinder is provided with a first pivoting recess communicating with the first through-hole. The pivoting seat is provided with a second pivoting recess communicating with the second through-hole. The connection member is provided with a third pivoting recess communicating with the third through-hole. The pivoting portion is pivotally connected to the first, second, and third pivoting recesses.

In an example, an outer periphery of the axial member is provided with at least one first airtight ring abutting against an inner periphery of the third through-hole, and at least one second airtight ring abutting against an inner periphery of the fourth through-hole.

In an example, the pivoting seat is provided with a shoulder portion formed around an inner periphery of the second through-hole. The joint member is provided with a first stop portion abutting against an outer periphery of the pivoting seat. The proximal end is provided with a second stop portion abutting against the shoulder portion.

In an example, one end of the piston rod is provided with a piston portion moveable relative to the cylinder, and another end of the piston rod is pivotally connected with a handle detachably abutting against an outer periphery of the cylinder.

In an example, the inflation assembly includes a cover member disposed on the cylinder. The piston rod is movably mounted through the cover member. The cover member is provided with a buckle portion detachably attached with the airflow tube.

The present invention will become clearer in light of the following detailed description of illustrative embodiments of this invention described in connection with the drawings.

DETAILED DESCRIPTION OF THE INVENTION

Figure 1:
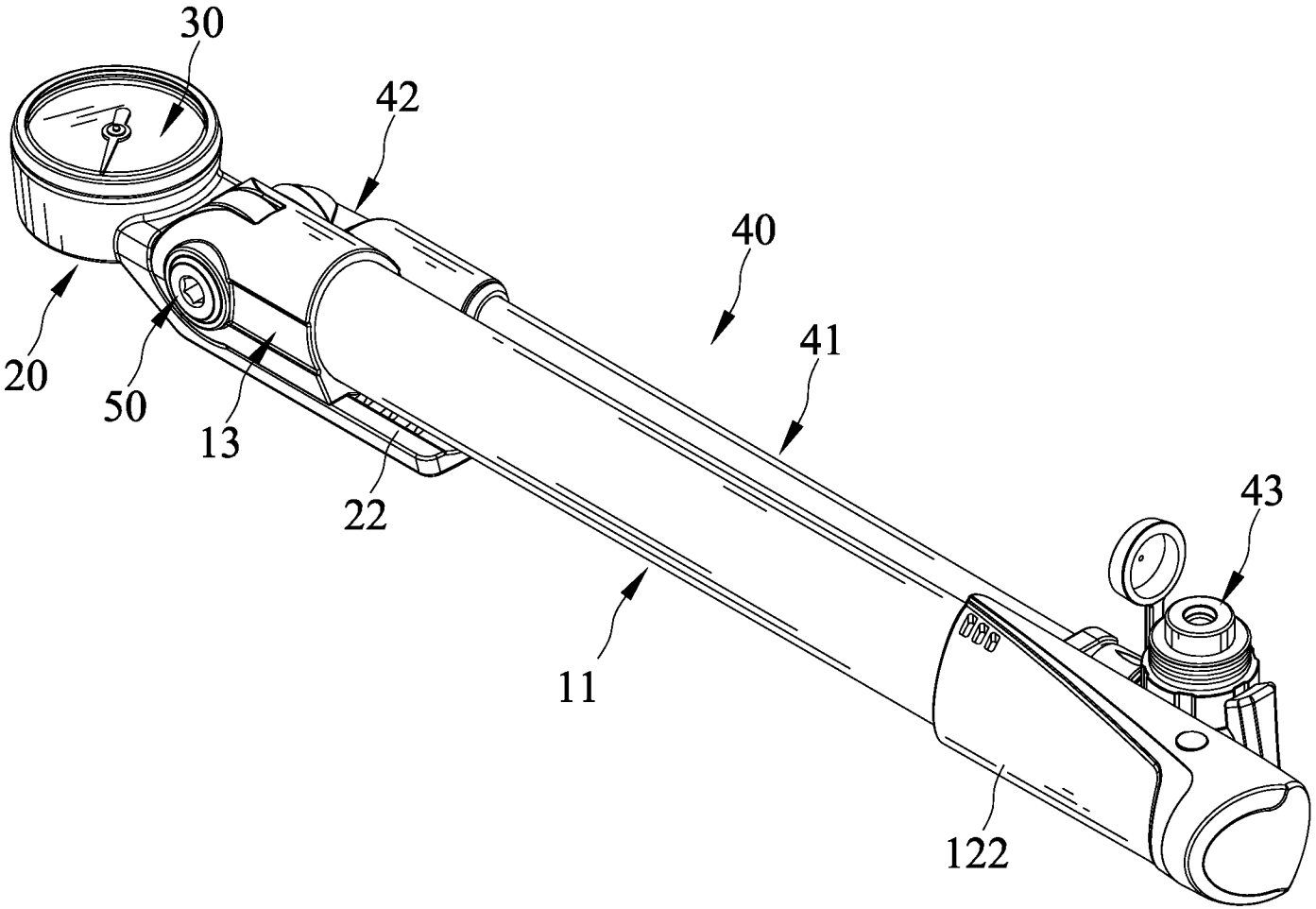
FIG. 1 is a perspective view of a portable air pump of an embodiment according to the present invention and shows the portable air pump is in a compact state.
Figure 2:
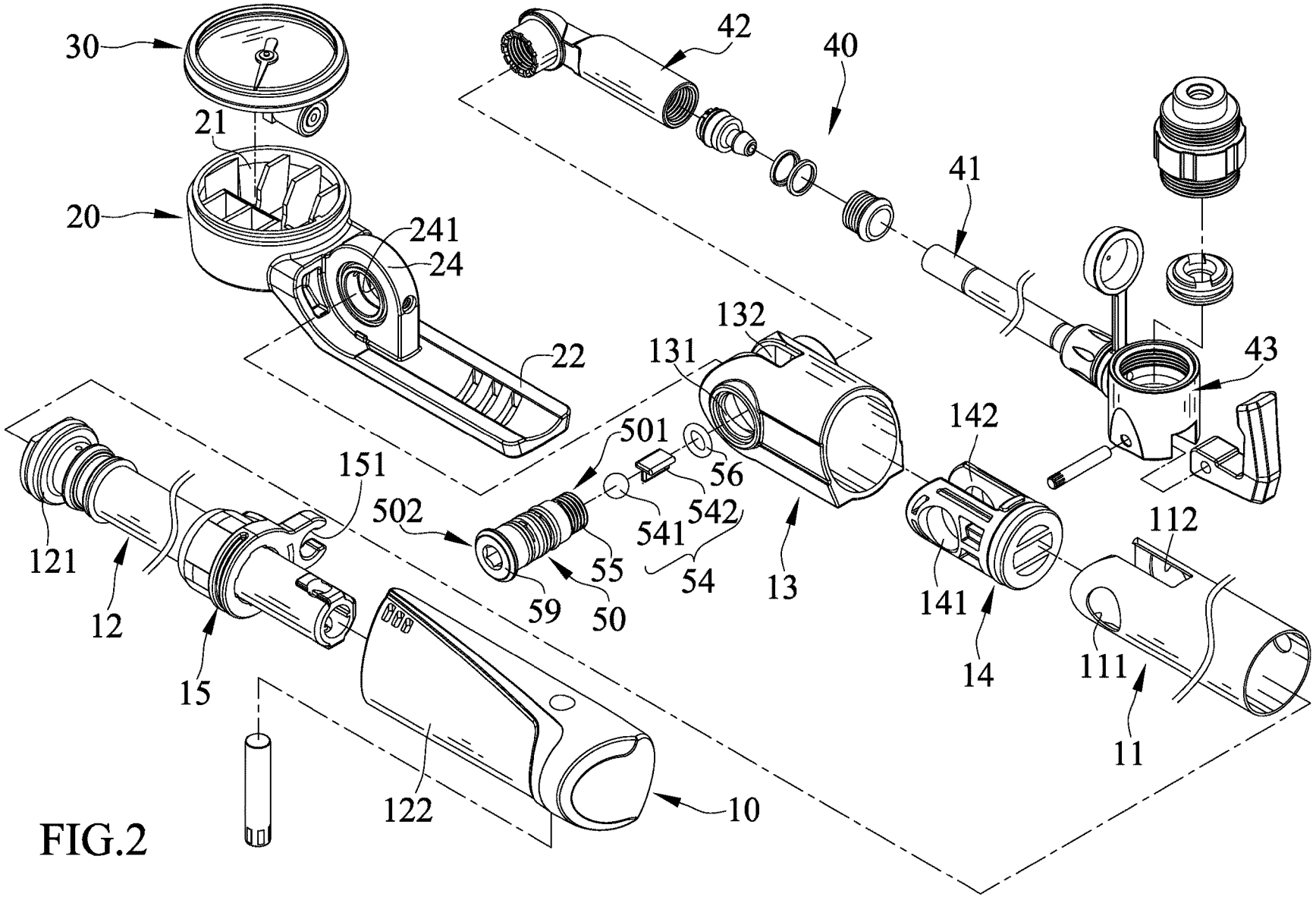
FIG. 2 is an exploded, perspective view of the portable air pump of FIG. 1.
Figure 3:
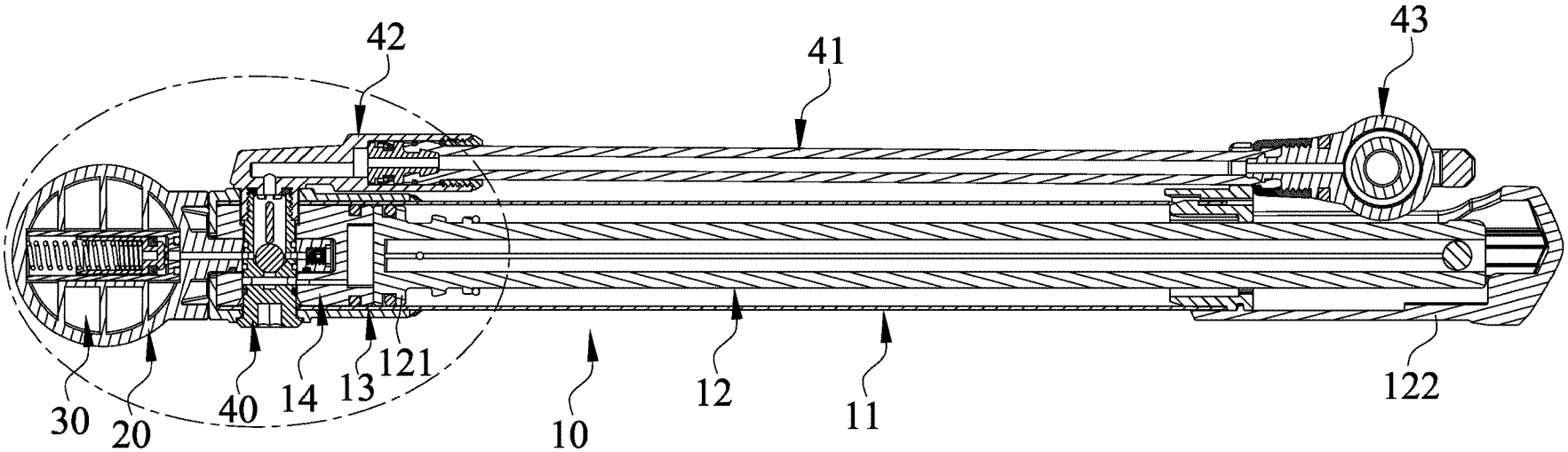
FIG. 3 is a cross sectional view of the portable air pump of FIG. 1.
Figure 4:
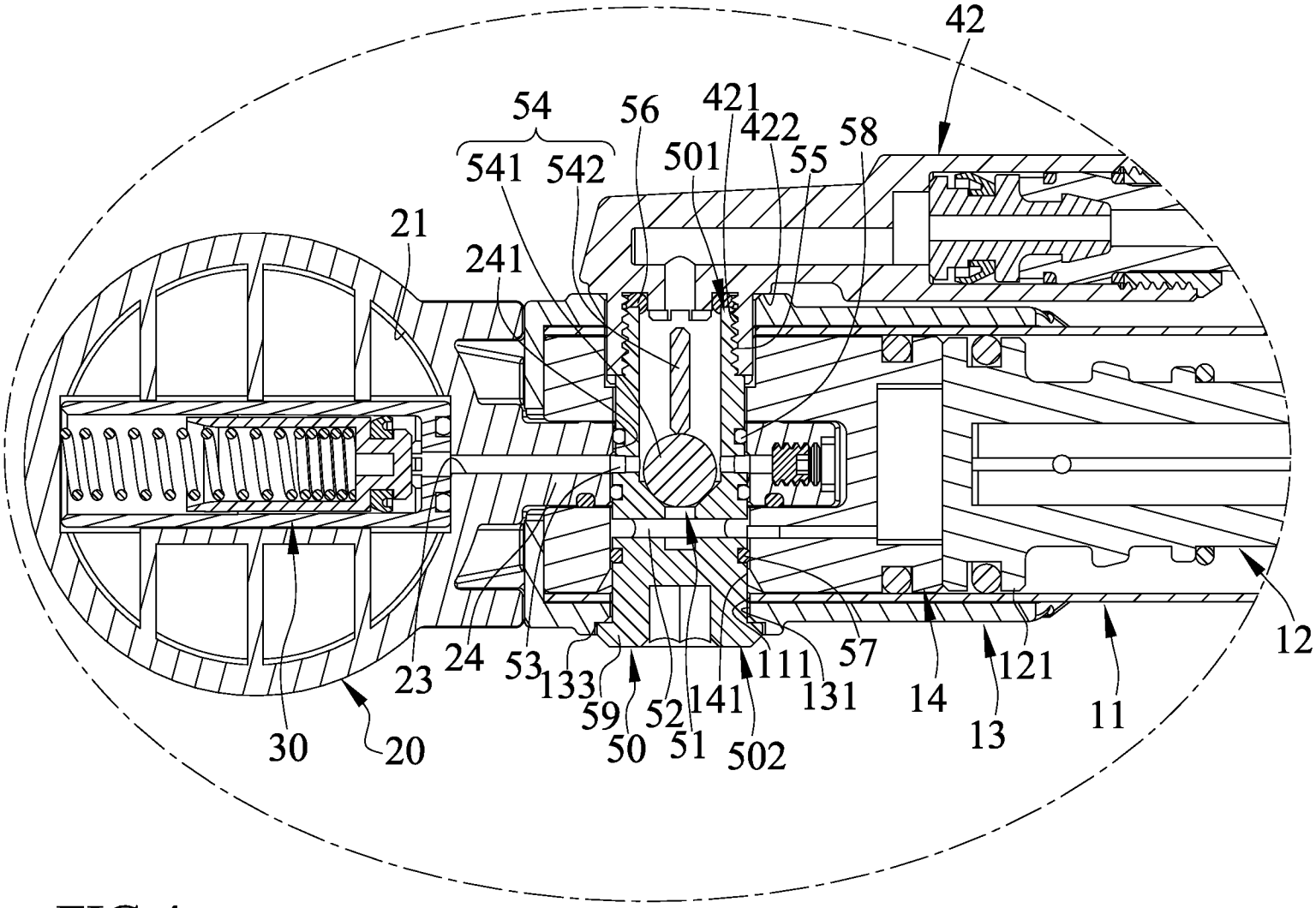
FIG. 4 is an enlarged view of a circled portion of FIG. 3.

With reference to FIGS. 1-5, a portable air pump of an embodiment according to the present invention includes an inflation assembly 10, a head seat 20 pivotally connected to the inflation assembly 10, a pressure gauge 30 disposed in the head seat 20, a connection assembly 40 pivotally connected to the inflation assembly 10, and an axial member 50 mounted through the inflation assembly 10 and the head seat 20 and connected to the connection assembly 40. Thus, the portable air pump according to the present invention can be assembled quickly and easily because the axial member 50 is mounted through the inflation assembly 10 and the head seat 20 and is connected to the connection assembly 40.

The inflation assembly 10 includes a cylinder 11, a piston rod 12, a pivoting seat 13 connected to the cylinder 11, a connection member 14 disposed in the cylinder 11, and a cover member 15 disposed on the cylinder 11. The piston rod 12 is moveable relative to the cylinder 11 to compress the air inside the cylinder 11. The cylinder 11 is provided with a first through-hole 111 and a first pivoting recess 112 communicating with the first through-hole 111. One end of the piston rod 12 is provided with a piston portion 121 moveable relative to the cylinder 11, and another end of the piston rod 12 is pivotally connected with a handle 122 detachably abutting against an outer periphery of the cylinder 11 to cause the portable air pump being changeable between a compact state and a use state. The pivoting seat 13 is provided with a second through-hole 131, a second pivoting recess 132 communicating with the second through-hole 131, and a shoulder portion 133 formed around an inner periphery of the second through-hole 131. The connection member 14 is provided with a third through-hole 141 and a third pivoting recess 142 communicating with the third through-hole 141. The first, second, and third pivoting recesses 112, 132, and 142 correspond each other. The piston rod 12 is movably mounted through the cover member 15, and the cover member 15 is provided with a buckle portion 151 detachably attached with the connection assembly 40.

One end of the head seat 20 is provided with a containing groove 21, and another end of the head seat 20 is provided with a pedal portion 22. The pressure gauge 30 is disposed in the containing groove 21. The head seat 20 is provided with a guiding hole 23 communicating with the containing groove 21, and a pivoting portion 24 disposed between the containing groove 21 and the pedal portion 22. The pivoting portion 24 is pivotally connected to the first, second, and third pivoting recesses 112, 132, and 142 to cause the head seat 20 being pivotable in relation to the inflation assembly 10. The pivoting portion 24 is provided with a fourth through-hole 241.

The connection assembly 40 includes an airflow tube 41, a joint member 42, and a valve connector 43. Two opposite ends of the airflow tube 41 are respectively connected to the joint member 42 and the valve connector 43, and the airflow tube 41 is detachably attached with the buckle portion 151 of the cover member 15 to cause the portable air pump being changeable between the compact state and the use state. The joint member 42 is pivotally connected to the second through-hole 131 of the pivoting seat 13 and is provided with a first threaded portion 421 and a first stop portion 422 abutting against an outer periphery of the pivoting seat 13. The valve connector 43 is adapted to connect with an air-inflatable object.

The axial member 50 is mounted through the first, second, third, and fourth through-holes 111, 131, 141, and 241 and then is connected to the joint member 42 of the connection assembly 40 to significantly simplify the assembly process. The axial member 50 is provided with an airflow channel 51, a first passage 52 communicating with the cylinder 11, and a second passage 53 communicating with the containing groove 21. The airflow channel 51 communicates with the cylinder 11, the containing groove 21, and the connection assembly 40, and the first and second passages 52 and 53 are communicated with the airflow channel 51. A check valve assembly 54 is disposed in the airflow channel 51 to cause the first passage 52 to unidirectionally communicate with the second passage 53. The check valve assembly 54 includes a check ball 541 and a limit member 542 abutting against the check ball 541. The size of the check ball 541 is configured to fit to block the air airflow channel 51, so that the first passage 52 communicates with the second passage 53 in one direction. The limit member 542 can have a T-shaped cross-sectional shape and be disposed in the airflow channel 51. The axial member 50 defines a distal end 501 and a proximal end 502 opposite to the distal end 501. The distal end 501 is provided with a second threaded portion 55 threadedly connected with the first threaded portion 421 to cause the axial member 50 can be connected to the joint member 42. The distal end 501 is abutted against a seal ring 56 disposed between the joint member 42 and the distal end 501. An outer periphery of the axial member 50 is provided with at least one first airtight ring 57 abutting against an inner periphery of the third through-hole 141, and at least one second airtight ring 58 abutting against an inner periphery of the fourth through-hole 241. In the embodiment, the number of the first airtight ring 57 is one and is adjacent to the first passage 52. The number of the second airtight ring 58 is two, and they are located on two sides of the second passage 53, respectively. The proximal end 502 is provided with a second stop portion 59 abutting against the shoulder portion 133.

FIGS. 1-4 show the portable air pump according to the present invention is in the compact state. The inflation assembly 10, the head seat 20, the pressure gauge 30, and the connection assembly 40 are in a linear arrangement for easy storage. The handle 122 abuts against the outer periphery of the cylinder 11. The airflow tube 41 is detachably attached with the buckle portion 151. The pedal portion 22 and the cylinder 11 are substantially parallel to each other.

Figure 5:
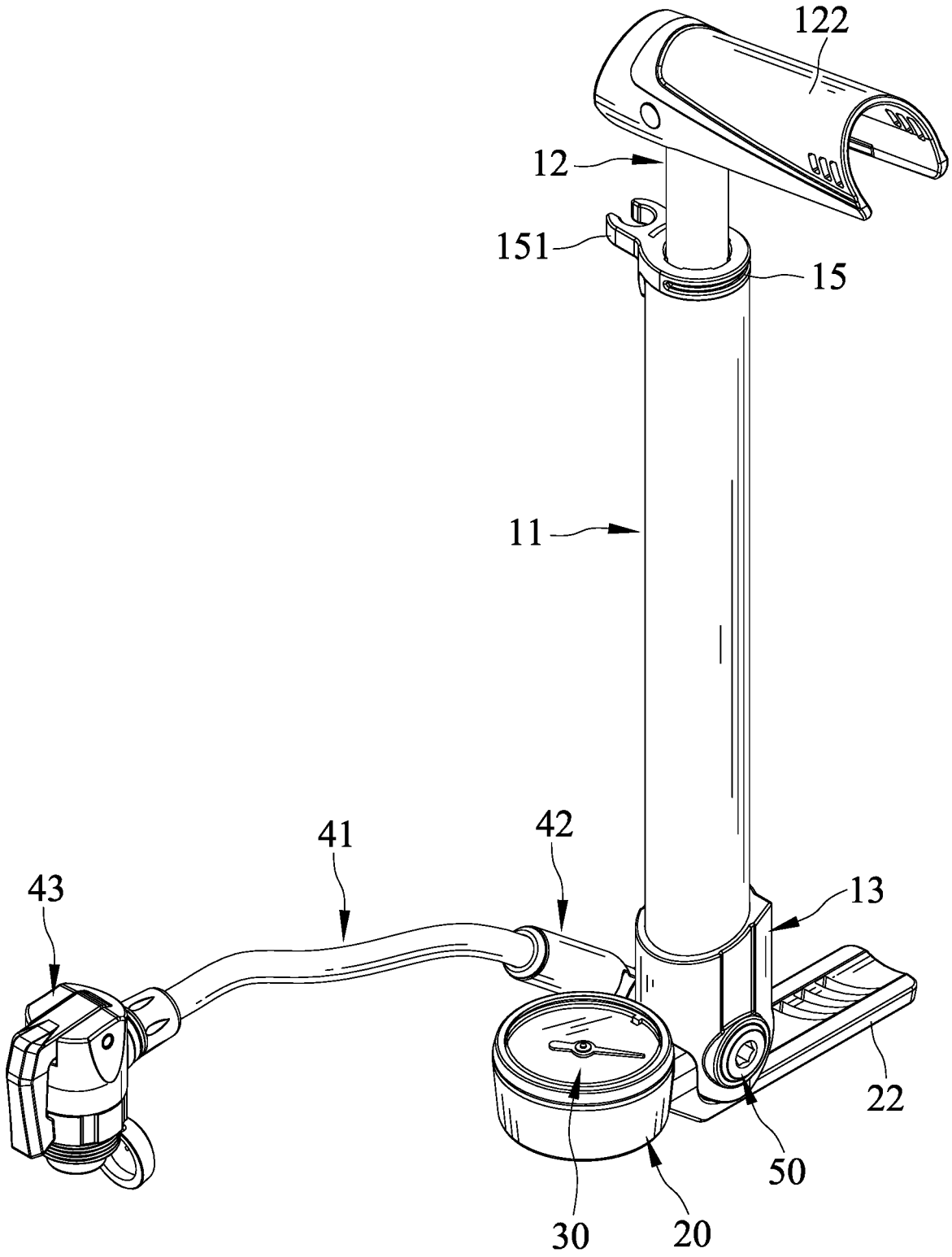
FIG. 5 is another perspective view of the portable air pump of FIG. 1 and shows the portable air pump is in a use state.

FIG. 5 shows the portable air pump according to the present invention is in the use state. The handle 122 is detached from the outer periphery of the cylinder 11 and is pivoted in relation to the piston rod 12 for a user to hold. The airflow tube 41 is detached from the buckle portion 151, and the joint member 42 is pivoted in relation to the pivoting seat 13 to cause the valve connector 43 is easy to connect with the air-inflatable object such as tire without being obstructed by other objects. The head seat 20 is pivoted in relation to the inflation assembly 10 to cause the pedal portion 22 and the pressure gauge 30 being arranged in an inverted T-shape with the cylinder 11, so that the user can step on the pedal portion 22 and hold the handle 122 to inflate at the same time, the pressure value can be observed through the pressure gauge 30.

Although specific embodiments have been illustrated and described, numerous modifications and variations are still possible without departing from the scope of the invention. The scope of the invention is limited by the accompanying claims.

The invention claimed is:

1. A portable air pump comprising:

an inflation assembly including a cylinder and a piston rod moveable relative to the cylinder to compress the air inside the cylinder, wherein the cylinder is provided with a first through-hole, wherein the inflation assembly includes a pivoting seat connected to the cylinder and a connection member disposed in the cylinder, wherein the pivoting seat is provided with a second through-hole, wherein the connection member is provided with a third through-hole;

a head seat pivotally connected to the inflation assembly, wherein one end of the head seat is provided with a containing groove and wherein another end of the head seat is provided with a pedal portion, wherein the head seat is provided with a pivoting portion disposed between the containing groove and the pedal portion, and wherein the pivoting portion is provided with a fourth through-hole;

a pressure gauge disposed in the containing groove;

a connection assembly pivotally connected to the inflation assembly and adapted to connect with an air-inflatable object; and an axial member mounted through the inflation assembly and the head seat and connected to the connection assembly, wherein the axial member is provided with an airflow channel communicating with the cylinder, the containing groove, and the connection assembly, and wherein the axial member is mounted through the first, second, third, and fourth through-holes.

2. The portable air pump as claimed in claim 1, wherein the head seat is provided with a guiding hole communicating with the containing groove, wherein the axial member is provided with a first passage communicating with the cylinder and a second passage communicating with the containing groove, and wherein the first and second passages are communicated with the airflow channel.

3. The portable air pump as claimed in claim 2, wherein a check valve assembly is disposed in the airflow channel to cause the first passage to unidirectionally communicate with the second passage.

4. The portable air pump as claimed in claim 3, wherein the check valve assembly includes a check ball and a limit member abutting against the check ball.

5. The portable air pump as claimed in claim 3, wherein the connection assembly includes an airflow tube, a joint member, and a valve connector, wherein two opposite ends of the airflow tube are connected to the joint member and the valve connector, wherein the joint member is provided with a first threaded portion, wherein the valve connector is adapted to connect with the air-inflatable object, wherein the axial member defines a distal end and a proximal end opposite to the distal end, and wherein the distal end is provided with a second threaded portion threadedly connected with the first threaded portion.

6. The portable air pump as claimed in claim 5, wherein the distal end is abutted against a seal ring disposed between the joint member and the distal end.

7. The portable air pump as claimed in claim 1, wherein the cylinder is provided with a first pivoting recess communicating with the first through-hole, wherein the pivoting seat is provided with a second pivoting recess communicating with the second through-hole, wherein the connection member is provided with a third pivoting recess communicating with the third through-hole, and wherein the pivoting portion is pivotally connected to the first, second, and third pivoting recesses.

8. The portable air pump as claimed in claim 1, wherein an outer periphery of the axial member is provided with at least one first airtight ring abutting against an inner periphery of the third through-hole, and at least one second airtight ring abutting against an inner periphery of the fourth through-hole.

9. The portable air pump as claimed in claim 1, wherein the pivoting seat is provided with a shoulder portion formed around an inner periphery of the second through-hole, wherein the joint member is provided with a first stop portion abutting against an outer periphery of the pivoting seat, and wherein the proximal end is provided with a second stop portion abutting against the shoulder portion.

10. The portable air pump as claimed in claim 1, wherein one end of the piston rod is provided with a piston portion moveable relative to the cylinder, and wherein another end of the piston rod is pivotally connected with a handle detachably abutting against an outer periphery of the cylinder.

11. The portable air pump as claimed in claim 1, wherein the inflation assembly includes a cover member disposed on the cylinder, wherein the piston rod is movably mounted through the cover member, and wherein the cover member is provided with a buckle portion detachably attached with the airflow tube.

* * * * *